US009808859B2

(12) United States Patent
Selmi

(10) Patent No.: US 9,808,859 B2
(45) Date of Patent: Nov. 7, 2017

(54) FURNACE ASSEMBLY

(71) Applicant: Donald Joseph Selmi, Brighton, MI (US)

(72) Inventor: Donald Joseph Selmi, Brighton, MI (US)

(73) Assignee: PREMIER FURNACE SPECIALISTS INC., Farmington Hills, MI (US)

( * ) Notice: Subject to any disclaimer, the term of this patent is extended or adjusted under 35 U.S.C. 154(b) by 176 days.

(21) Appl. No.: 14/834,584

(22) Filed: Aug. 25, 2015

(65) Prior Publication Data

US 2016/0052048 A1 Feb. 25, 2016

Related U.S. Application Data

(60) Provisional application No. 62/041,302, filed on Aug. 25, 2014.

(51) Int. Cl.

| | |
|---|---|
| ***F27B 9/20*** | (2006.01) |
| ***B22C 17/00*** | (2006.01) |
| ***B22C 9/04*** | (2006.01) |
| ***B22C 19/00*** | (2006.01) |
| ***F27D 17/00*** | (2006.01) |
| ***B22C 23/00*** | (2006.01) |
| ***F27B 9/30*** | (2006.01) |
| ***F27D 99/00*** | (2010.01) |
| *F27D 3/00* | (2006.01) |

(52) U.S. Cl.

CPC ..... *B22C 17/00* (2013.01); *B22C 9/043* (2013.01); *B22C 19/00* (2013.01); *B22C 23/00* (2013.01); *F27B 9/20* (2013.01); *F27B 9/30* (2013.01); *F27B 9/3005* (2013.01); *F27D 17/001* (2013.01); *F27D 99/0033* (2013.01); *F27D 2003/0034* (2013.01)

(58) Field of Classification Search

CPC ..... F27B 9/20; B09B 3/005

USPC ..... 432/9, 11, 13, 74, 120, 128, 133, 143, 432/144, 146, 148, 217

See application file for complete search history.

(56) References Cited

U.S. PATENT DOCUMENTS 1,970,320 A * 8/1934 Kier ..... F27B 9/32 15/183

3,108,351 A * 10/1963 Hermans ..... F27B 9/3011 432/133

(Continued)

*Primary Examiner* — Gregory A Wilson

(74) *Attorney, Agent, or Firm* — Craig A. Phillips; Dickinson Wright PLLC

(57) ABSTRACT

A furnace assembly for dewaxing investment casting molds includes a housing having a top and a bottom and sides and extends along an axis to define a cavity. A plurality of tiles are supported in a spaced relationship with the bottom of the housing and define a pair of lower chambers for directing the wax vapors out of the cavity. A plurality of trays having apertures are supported by the tiles for moving molds through the housing. Chimneys connect to the lower chambers and a passageway is defined by the tiles for evacuating the wax and wax vapors from the cavity to the lower chambers and out through the chimneys. A pair of lower burners extends into the lower chambers for igniting wax vapors in said lower chambers. The heat from the lower chambers radiantly heats up portions of the furnace assembly that are disposed above the lower chambers.

26 Claims, 7 Drawing Sheets

(56) References Cited

U.S. PATENT DOCUMENTS

| | | | | | |
|---|---|---|---|---|---|
| 3,172,648 | A * | 3/1965 | Brichard | C03B 3/023 | 432/101 |
| 4,005,981 | A * | 2/1977 | Turnbull | F27B 9/3011 | 432/128 |
| 4,569,658 | A * | 2/1986 | Wiggins | A21B 1/48 | 34/216 |
| 4,609,031 | A * | 9/1986 | Sasaki | B22D 31/002 | 164/270.1 |
| 5,372,177 | A * | 12/1994 | Foster | B22C 9/043 | 126/343.5 A |
| 6,336,809 | B1 * | 1/2002 | Crafton | B22D 29/003 | 164/131 |
| 7,950,921 | B1 * | 5/2011 | Woolsey | F27B 9/20 | 432/128 |
| 8,196,799 | B2 * | 6/2012 | Dautenhahn | B23K 1/0016 | 228/42 |
| 9,234,700 | B1 * | 1/2016 | Gaur | F26B 21/12 | |
| 2014/0186786 | A1 * | 7/2014 | Mori | F27B 9/22 | 432/88 |

* cited by examiner

FURNACE ASSEMBLY

CROSS-REFERENCE TO PRIOR APPLICATIONS

This U.S. utility patent application claims the benefit U.S. Provisional Patent Application Ser. No. 62/041,302 filed Aug. 25, 2014, entitled "Furnace Assembly," the entire disclosure of the application being considered part of the disclosure of this application and hereby incorporated by reference.

BACKGROUND OF THE INVENTION

1. Field of the Invention

A furnace assembly for dewaxing investment casting molds, and a method of operating the furnace.

2. Description of the Prior Art

Furnaces are widely used in investment casting to dewax molds used in the process. Such furnaces must be able to reach a temperature suitable for melting the wax used to form the mold. The wax that is melted from the molds is traditionally recovered for use in other molds. Generally, such a dewaxing furnace assembly includes a housing defining a heating chamber for heating the molds and allows the wax from the molds to drip down out of the molds. If the wax ignites, in some furnaces, the wax is then extinguished using a gas or steam injector that injects an inert gas or steam into an extinguishing chamber below the heating chamber, so that any wax dripping into the extinguishing chamber may be cooled and extinguished. The wax is then collected in a tray, allowing the wax to be recovered and possibly reused. This necessitates a means to collect and recycle or dispose of the recovered wax, which is expressive and time consuming, and may require cooling of the furnace at regular intervals, which is also expensive and time intensive.

Other dewaxing furnace assemblies are configured to burn the wax and generally include a housing that defines a heating chamber for heating the molds and allows the wax from the molds to drip down out of the molds. Wax vapors are not exhausted and wax is not removed from the heating chamber but instead are burnt within the heating chamber. Additionally, these furnace assemblies heat and dewax the molds in a single operation, which may allow unburnt wax and wax vapor to accumulate on the investment casting molds in the furnace assembly or reach ignition temperature before it is fully melted and absent from the molds. One problem with these types of furnaces is that they allow the wax to burn and contaminate the inner surfaces of the casting molds as well as the carriers, such as trays. Investment casting furnaces of this type generally require a lot of heat energy to operate and the heat energy is provided exclusively by flammable gases such as natural gas or electric heating elements. In addition, any wax burned in the same chamber or on the investment casting molds may leave behind carbon deposits that are undesired and may negatively affect the later molding process.

SUMMARY OF THE INVENTION

The invention provides for a furnace assembly including at least one upper chamber and at least one lower chamber interconnected to the upper chamber by at least one passageway. At least one lower burner extends into the lower chamber for burning wax vapors and wax drippings flowing through the passageway into the lower chambers and heating the lower chamber and upper chamber.

Thus, several advantages of one or more aspects of the invention include that the wax drippings and unburnt wax vapors are drawn down through the passageway into the lower chamber while igniting the vapors and wax in the lower chamber in a controlled manner. The burning wax helps to reduce the amount of fuel required to heat the furnace. The unique design and downward flow of vapors and wax substantially prevents the wax from burning proximate to the investment casting molds and contaminating the inner surfaces of the casting molds.

The present invention is directed to a furnace that generally includes an outer housing defining an inner cavity. The inner cavity is divided, such as with furnace bricks or tiles into an upper chamber and a lower chamber. The outer housing includes a door at a first end. The opposing second end may have a door, but it has been found preferable to be open and without a door covering the opening and the second end. A chimney having an opening substantially aligned with the lower chamber is included, preferably one chimney for each side, located between said first end and said second end. At least one burner extends into the lower chamber and at least one burner extends into the upper chamber. A passageway located proximate to the first end extends between the lower chamber and the upper chamber.

The lower chamber includes a divider extending along the majority of the length of the lower chamber between the first end and the chimney, and wherein the divider divides the lower chamber into two longitudinally extending chambers. The at least one burner extending into the lower chamber includes a first lower burner aligned with one of the two longitudinally extending chambers and a second lower burner aligned with the other of the two longitudinally extending chambers. These are larger burners and configured to assist with creating the venture effect in the lower chamber. The first and second lower burners are located on the first end under the door. More specifically, the first and second lower burners are each configured to force hot air, gases, vapor and wax from the first section through the second section and to the third section of the lower chamber and to the at least one chimney. The burned wax and hot air then passes through the opening and out the chimney, where a chimney burner may burn any un-combusted materials, and an air system may further improve draw and dilute any emissions. More specifically, the first and second lower burners in combination with the second section create a venturi effect in the first section by drawing air from the upper chamber through the passageway to the lower chamber.

The first section is adjacent to the entrance and wherein the passageways are located within the first section, a second section adjacent to the first section and extending away from the first end, a third section adjacent to the second section and wherein the chimneys are located in the third section and a fourth section extending away from the third section The lower chamber in the first and second sections are divided by a longitudinally extending divider. The divider is configured to reduce the cross sectional area of the lower chamber into smaller sections, thereby improving the venture effect desired. The third section is substantially free from the longitudinally extending divider, which improves air flow to the chimney opening. The third section further includes in the lower chamber a laterally extending barrier aligned with the opening on the chimney and wherein the opening extends past both sides of the barrier. The barrier forces the gas toward the opening on the chimney, and also allows the opening on the chimney to draw air from the force section (on the opposite side of the barrier as the third section), and thereby create a negative pressure in the fourth section, such that the second end may have an open opening, not covered by a door and use the entering ambient air to cool the products on their trays that are passing through the fourth section, without interfering with the heating process occurring in the first and second sections. In addition, the lower chamber does not extend into the fourth section and wherein the fourth section terminates in an opening at the second end, which is not covered by a door.

The furnace chimney includes a chimney burner, and may include a fresh air inlet.

In addition, the furnace includes as the at least one upper burner, a plurality of upper chamber burners on a first side and a plurality of upper chamber burners on an opposing second side in the second section, and wherein the plurality of upper burners on the first side are staggered relative to the plurality of upper chamber burners on the second side. These plurality of staggered burners are in the second section, but the first section may also include a plurality of upper chamber burners, although these may not be staggered to maximize heating of the molds after entry and closure of the door, to have the wax melt out of the molds as quickly as possible. The passageways are located within the first section, and allow wax vapors to be pulled into the lower chamber, and liquid wax to drip down through the holes on the trays, through the passageways, where the lower burner ignites such wax and wax vapors. The inner side of the outer housing is lined with furnace bricks or tiles in the upper chamber and the lower chamber in the first section. The bricks or tiles may form an arched overhead shape, while defining the lower floor of the upper chamber, which is also the roof of the lower chamber. In the second section, the upper chamber is fiber lined and furnace brick lined in the lower chamber in the second section. Partitions extend downward from the roof of the upper chamber, including a first partition the divides the first and second sections. The partitions allow better heat control and more consistent temperatures as the investment castings move from the first end to the second end. The second section may include multiple partitions, and a partition may divide the second and third sections as well as the third and fourth sections.

A material handling system to move products from the first end to the second end. The material handling system must be able to withstand the heat, and works in conjunction with the opening and closing of the door on the furnace.

The present invention is further directed to a furnace assembly comprising a housing having a longitudinal extent and a latitudinal extent and a top and a bottom and a first side and a second side and extending along the longitudinal extent to define a cavity; at least one chimney connected to the housing; at least one burner extending into the cavity; a plurality of tiles supported in a spaced relationship with the bottom of the housing and defining at least one lower chamber extending along the longitudinal extent for containing combustion of vapors along the chamber and directing the vapors from the cavity to the chimneys; and a passageway defined by the tiles extending through the tiles for evacuating the vapors from the cavity to the lower chambers.

The present invention is further directed to a dewaxing furnace assembly for investment casting comprising: a housing having a longitudinal extent and a latitudinal extent and a top and a bottom and a first side and a second side and extending along an axis to define a cavity; at least one chimney connected to the housing; at least one burner extending into the cavity; a plurality of tiles supported in a spaced relationship with the bottom of the housing and defining at least one lower chamber extending along the longitudinal extent for containing combustion of wax vapors along the chamber and directing the wax vapors from the cavity to the chimneys; a passageway defined by the tiles extending through the tiles for evacuating the wax vapors from the cavity to the lower chambers; and at least one burner extending into the lower chambers for igniting wax vapors in the lower chambers.

The present invention is further directed to a dewaxing furnace assembly for investment casting comprising: a housing having a longitudinal extent and a latitudinal extent and a top and a bottom and a first side and a second side and extending along the longitudinal extent to define a cavity; at least one chimney connected to the housing; a plurality of tiles supported in a spaced relationship with the bottom of the housing and defining at least one lower chamber extending along the longitudinal extent for containing combustion of wax vapors along the chamber and directing the wax vapors from the cavity to the chimneys; a passageway defined by the tiles extending through the tiles for evacuating the wax vapors from the cavity to the lower chambers; at least one burner extending into the lower chambers for igniting wax vapors in the lower chambers; a plurality of trays for carrying investment casting molds along the housing; and the trays each having at least one aperture for allowing heat to rise to molds on the trays and for allowing molten wax from the molds to drop through the trays into the lower chambers through the passageway.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
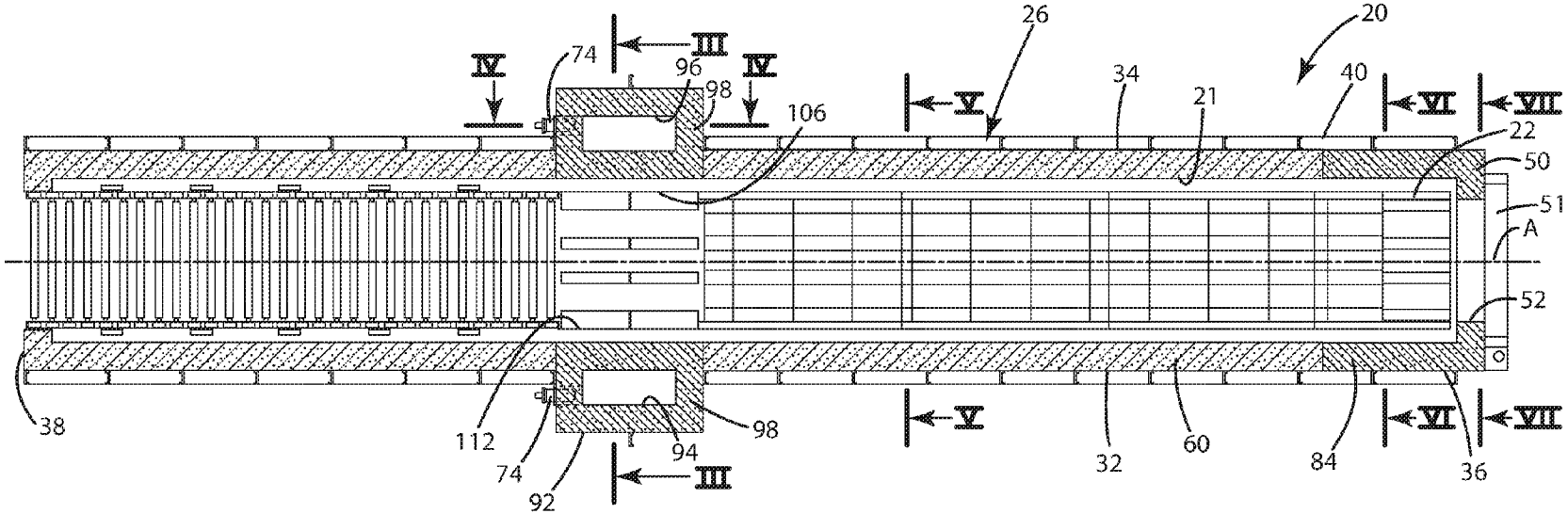
FIG. 1 is a cross-sectional view of the furnace assembly.

Referring to the Figures, wherein like numerals indicate corresponding parts throughout the several views, a furnace assembly 20 constructed in accordance with the subject invention is shown in the Figures. The furnace assembly 20 is generally intended to be used for heating and dewaxing investment casting molds; however, it should be appreciated that the furnace assembly 20 could be used for heating of various other items.

The furnace assembly 20 includes an outer housing 26 divided into an upper chamber 21 and at least one lower chamber 24. At least one burner 66, 68, 72, 74 is disposed in the housing 26 for heating the upper chamber 21 and heating the at least one lower chamber 24. At least one chimney 94, 96 is connected to the housing and to the at least one lower chamber 24 for exhausting air and vapors from the lower chambers 24 that originate in the upper chamber 21 to cause wax and vapors to be quickly moved from the upper chamber 21 into the lower chambers 24.

In dewaxing furnaces, wax drippings and vapors may not be properly evacuated from the furnace assembly 20, or may be burned while still inside the casting mold. Most waxes including Parafin wax that are commonly used in investment casting are flammable and may leave carbon deposits on the molds and even impregnate the ceramic mold and the apparatus used to move the molds through the furnace assembly 20.

Dewaxing furnaces generally require substantial amounts of heat energy to operate, which is usually supplied exclusively through the use of natural gas and/or electric heating elements. The furnace assembly 20, generally shown in FIGS. 1 and 2, reduces the amount of heat input required during operation, and keeps the carbon deposits and any vapors removed from the casting molds and trays 124 by first melting the wax out of the casting molds through the trays 124 and down through a passageway 22 (FIG. 9) into the at least one lower chamber 24. Once in the at least one lower chamber 24, the wax, including vapors is burnt which heats the lower chamber and provides an even heat through the tiles 64 into the upper chamber 21 to in turn heat the investment casting molds travelling through the furnace assembly 20. The wax being burnt in the at least one lower chamber 24 can cause the temperature in the lower chambers 24 to be as high as 2000 degrees F. The heat from the lower chambers 24 radiantly heats up the upper chamber 21 of the furnace assembly that is disposed above the lower chambers 24. Because the vapors and wax are burned as they travel through the lower chambers 24, they contribute to a more gradual rise in temperature along the furnace assembly 20, rather than an elevated temperature spike in only one section of the furnace assembly 20. Without the burning of the wax, an air to fuel ratio (using natural gas) of 10 to 1 is generally required in the furnace assembly 20. However, due to the wax burning, a greater proportion of air can be used, decreasing the amount of fuel needed, which can lead to a fuel savings of 10% or more.

The outer housing 26 of steel, generally indicated of the furnace assembly 20 has a longitudinal extent and a latitudinal extent and a top 28 and a bottom 30 extending generally parallel to the top 28 along the longitudinal extent. The housing 26 includes a first side 32 attached to and extending between the top 28 and the bottom 30 and extending along the longitudinal extent. A second side 34 is attached to and also extends between the top 28 and the bottom 30 and extends generally aligned or parallel to the first side 32. The top 28 and the bottom 30 and the first side 32 and the second side 34 of the housing 26 define an exterior surface and an interior surface and defining a cavity therein split into at least one lower chamber 24 and an upper chamber 21. An entrance 36 is also defined at one end and an exit 38 is defined at the opposite end of the housing 26. A plurality of ribs 40 of steel attaches to and extends radially from the exterior surface for providing strength and rigidity to the housing 26. Although the housing 26 and ribs 40 of the preferred embodiment are constructed of steel, it should be appreciated that other materials may be used instead.

Figure 2:
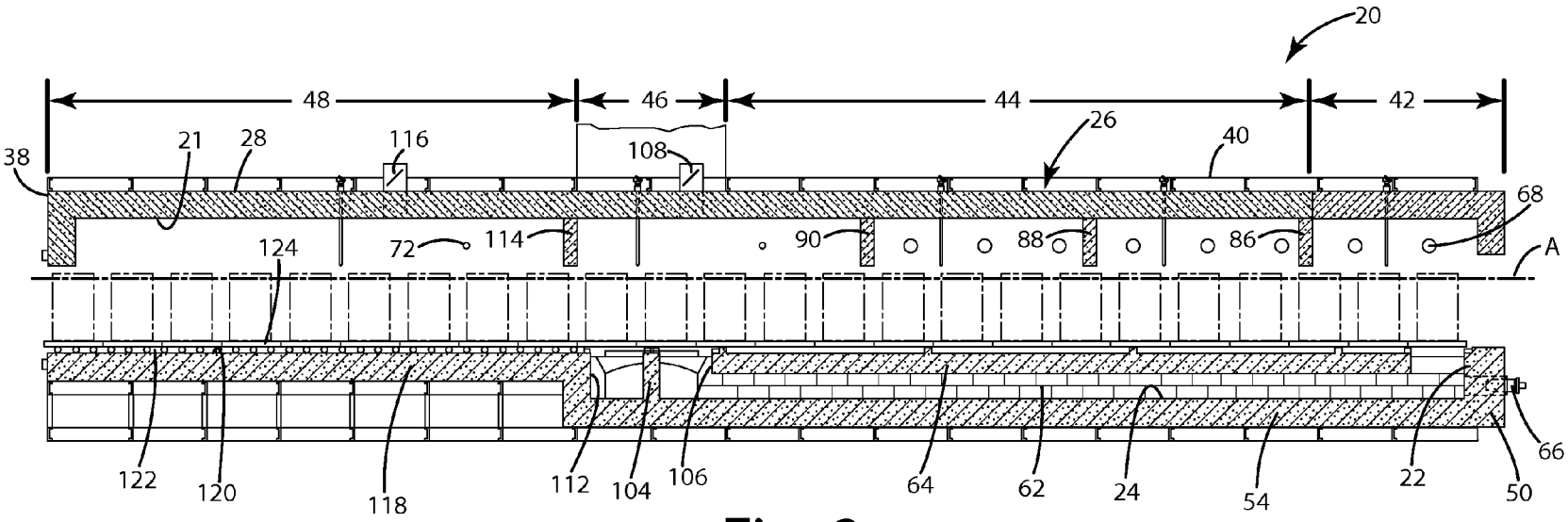
FIG. 2 is a cross-sectional view of the furnace assembly.
Figure 3:
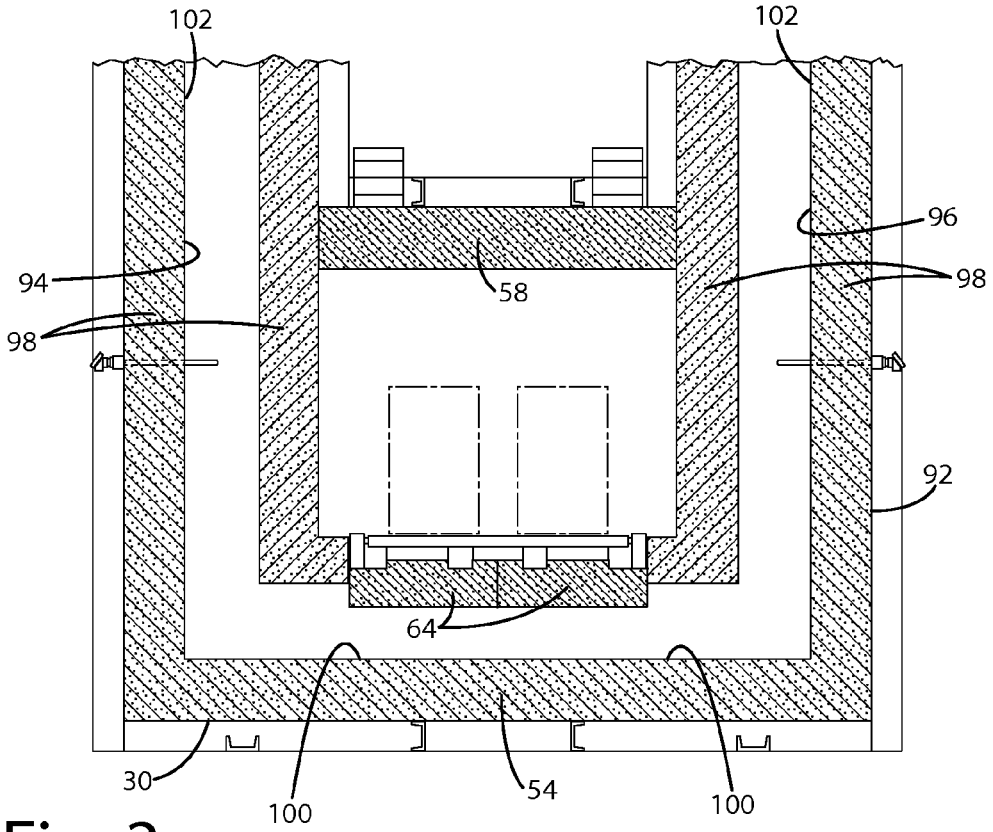
FIG. 3 is a cross-sectional view of the furnace assembly taken along III-III of FIG. 1.

As best shown in FIG. 2, the housing 26 defines a first section 42 adjacent to the entrance and extending along the longitudinal extent a first length. The housing 26 further defines a second section 44 adjacent to the first section 42 and extending along the longitudinal extent away from the first section 42 a second length. Additionally, the housing 26 defines a third section 46 adjacent to the second section 44 and extending along the longitudinal extent away from the second section 44 a third length. The housing 26 defines a fourth section 48 adjacent to the first section 42 and extending along the longitudinal extent away from the first section 42 a fourth length. Of course, the number of sections may vary. The process in each section for the preferred embodiment is further discussed below.

Figure 9:
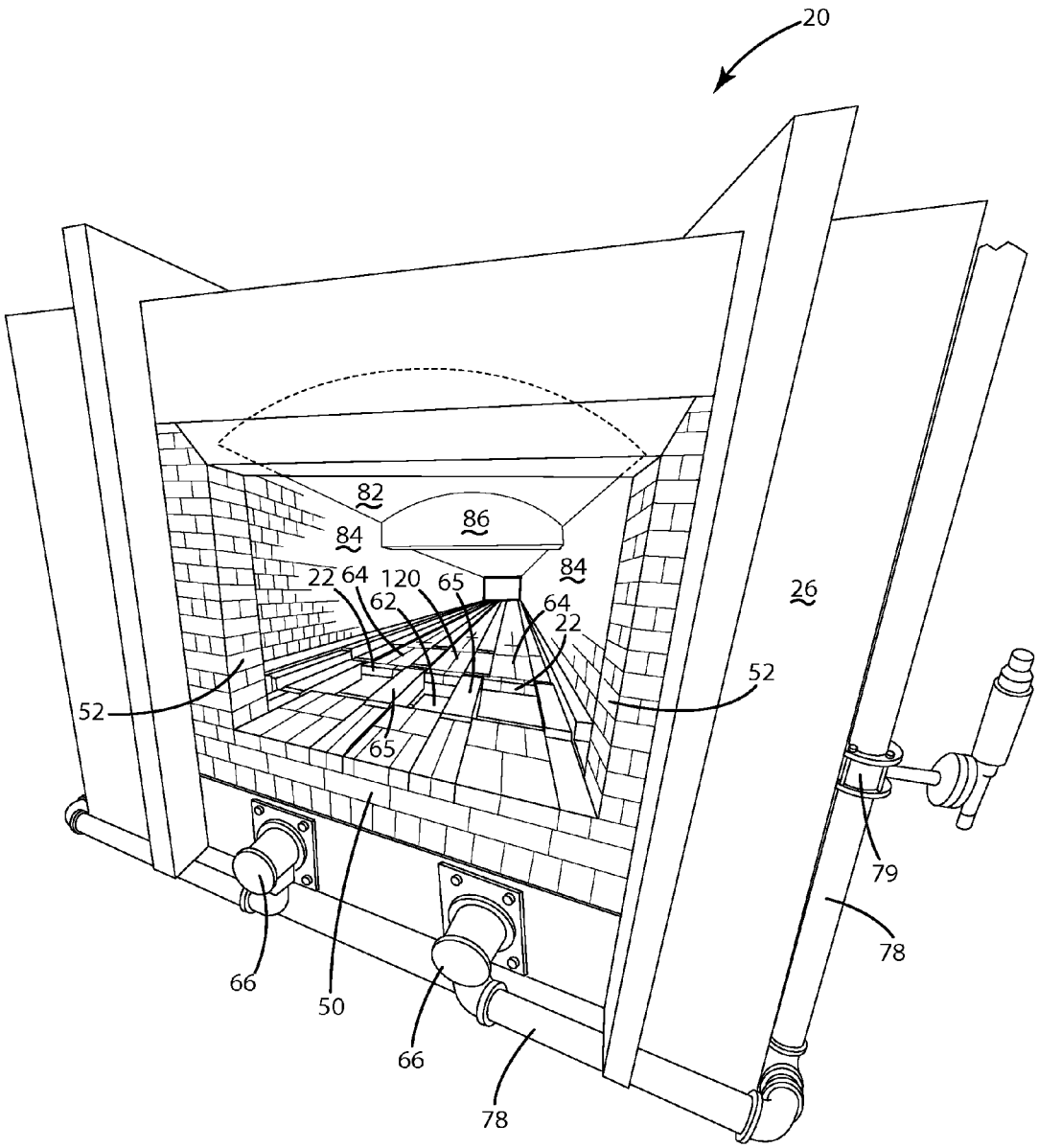
FIG. 9 is a perspective view of the furnace assembly illustrating the entrance of the furnace assembly.

A front wall 50 illustrated as brick in FIG. 9 is disposed in the entrance of the housing 26 and defines a charge door opening 52 having a generally rectangular shape and including an upper archway. Although not illustrated, at least one door capable of being opened and closed is arranged at the charge door opening 52 selectively covered with a door 51 as illustrated in FIG. 1 as well as at the exit 38 of the housing 26. It should be appreciated that the charge door opening 52 could be other shapes such as, but not limited to square shaped or rectangular without an upper archway. A plurality of lower bricks 54 are disposed on the bottom 30 of the housing 26 and extend along the longitudinal extent from the front wall 50 along the first section 42 and the second section 44 and the third section 46. A plurality of foundation bricks 56 are disposed on the first side 32 and on the second side 34 of the housing 26 and extend from the lower bricks 54 toward the top 28 of the housing 26 a predetermined height. The foundation bricks 56 extend from the front wall 50 along the first length and the second length to the third section 46. The bricks used in the preferred embodiment may be fire bricks that are made to withstand high temperatures. It should be understood that other materials such as various other ceramic or refractory materials may be used instead.

Figure 5:
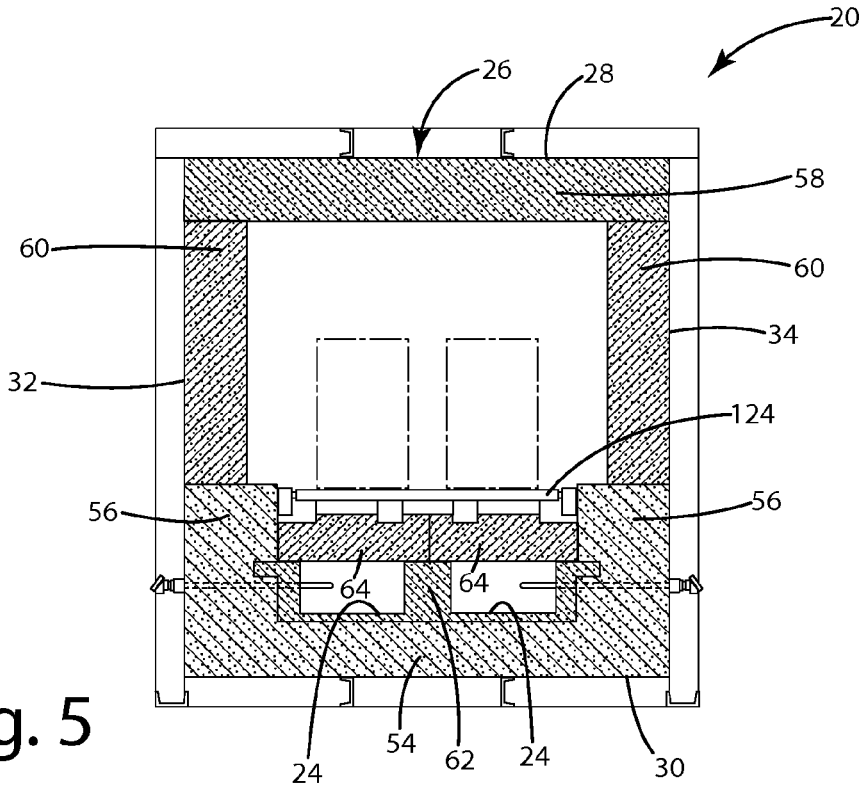
FIG. 5 is a cross-sectional view of the furnace assembly taken along V-V of FIG. 1.
Figure 6:
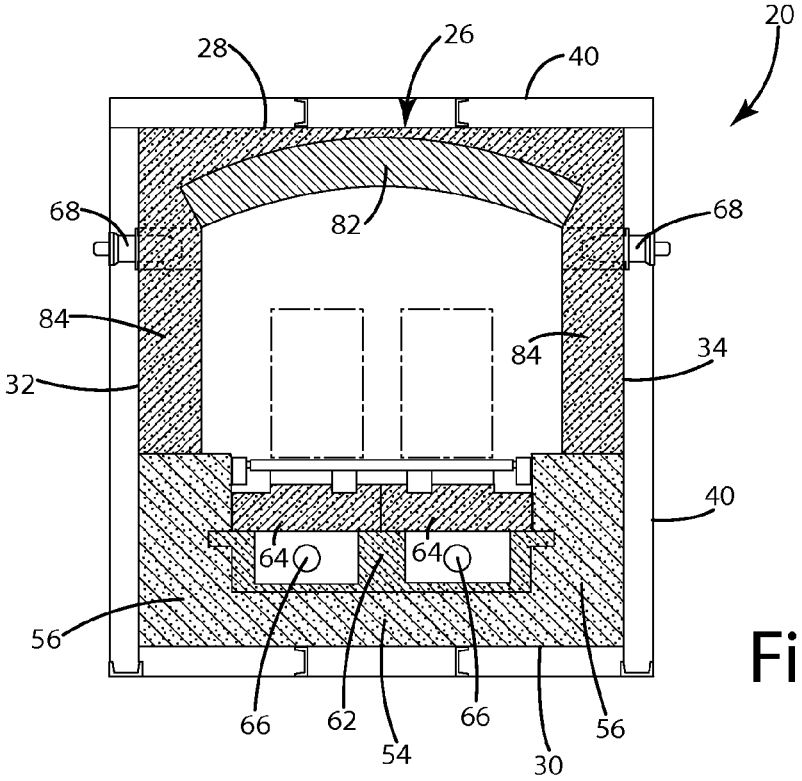
FIG. 6 is a cross-sectional view of the furnace assembly taken along VI-VI of FIG. 1.
Figure 7:
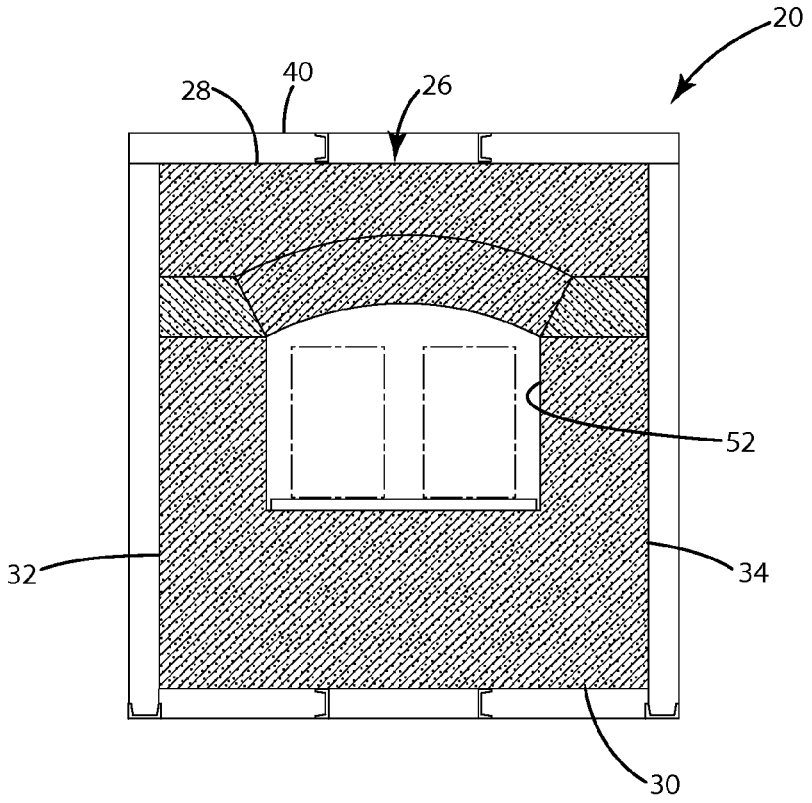
FIG. 7 is a cross-sectional view of the furnace assembly taken along VII-VII of FIG. 1.

As illustrated in FIGS. 2, 5, and 6, a divider 62 may divide the at least one lower chamber 24 into two lower chambers 24 and provide support for a plurality of tiles 64. The divider 62 extends from the lower bricks 54 along the first and second length in the first and second sections 42, 44 of the housing 26 and extends from the lower bricks 54. The tiles 64 are supported by and extend between the divider 62 and the foundation bricks 56 on the first side 32 and extending between the divider 62 and the foundation bricks 56 on the second side 34. The tiles 64 are in a spaced relationship with the lower bricks 54 and extend along the first length and the second length to the third section 46. The foundation bricks 56 and the tiles 64 and the divider 62 and the lower bricks 54 define the pair of lower chambers 24 extending along the longitudinal extent and along the first section 42 and the second section 44 for containing the combustion of the wax vapors along the second length and directing the wax vapors to the third section 46. The passageway 22 having a generally rectangular shape is defined by the front wall 50 and the tiles 64. The passageway 22 extends through the tiles 64 for evacuating the wax vapors in the first section 42 to the lower chambers 24. This flow of vapors through the passageway 22 and into the lower chambers 24 causes a negative pressure in the first section 42 of the furnace assembly 20 which causes all flames and smoke from the burning wax to be sucked into the lower chambers 24. A grate 65 (FIG. 9) is disposed in the passageway 22 for supporting molds as they are moved across the passageway 22. The cycle time of molds passing through the furnace assembly 20 can be timed such that there is enough dwell time to burn up all of the wax from the molds. For example, with molds moving through the furnace assembly 20 at 4 ft/sec, a dwell time of 8 seconds was utilized to burn up the wax on the molds. Generally, an appropriate dwell time would depend on the amount of wax used in the molds, as well as the type of wax, and possibly even the actual shape of the molds.

A plurality of upper fiber panels 58 are disposed on and attached to the top 28 of the housing 26 and extend along the longitudinal extent along the second length and the third length and the fourth length to the exit of the housing 26. A plurality of side fiber panels 60 are disposed on and attached to the first side 32 and the second side 34 of the housing 26 and extend along the longitudinal extent and along the second length and the fourth length of the housing 26. The fiber panels 58, 60 help insulate and maintain consistent temperatures in the areas of the furnace assembly 20 in which they are used.

The lower burners 66, large side burners 68 and small side burners 72 used in the furnace assembly 20 are interconnected by a plurality of gas supply pipes 76 for connection to a gas supply. The gas supply pipes 76 are only partially illustrated in the Figures. A plurality of air supply pipes 78 also interconnect the burners 66, 68, 72, 74 for connection to an air supply. At least one valve 79 (FIGS. 9 and 10) is connected to the air supply pipes 78 for controlling the amount of air allowed to the lower burners 66. At least one centrifugal air pump 80 (FIG. 10) connected to the air supply pipes 78 for increasing the flow of air to the burners 66, 68, 72, 74. This allows an optimal mixture of fuel to air to be used in each burner. A plurality of sensor ports 81 (FIG. 10) are defined by the housing 26 of the furnace assembly 20. Additionally, temperature sensors or thermocouples are disposed in the furnace assembly 20 so that the burners 66, 68, 72, 74 can be adjusted accordingly. In the preferred embodiment, these sensors are disposed in the sensor ports 81 and adjacent to the burners 66, 68, 72, 74, but it should be appreciated that they may instead be placed in various other locations in the furnace assembly 20.

In the first section 42, a plurality of upper bricks 82 (FIG. 9) are disposed in an arch shape on the top 28 of the housing 26 and extending along the longitudinal extent from the front wall 50 the first length to the second section 44. A plurality of side bricks 84 are adjacent to the first side 32 of the housing 26 and adjacent to the second side 34 of the housing 26. The side bricks 84 extend from the front wall 50 along the distance of the first length. The tiles 64 and the upper bricks 82 and the side bricks 84 of the first section 42 define a first heating zone. The least one lower burner 66, illustrated in FIG. 9 extends along the longitudinal extent through the front wall 50 into the lower chambers 24 for burning wax vapors and wax drippings flowing through the passageway 22 into the lower chambers 24. A plurality of large side burners 68 (FIG. 10) are spaced at predetermined intervals along the first section 42 and extend through the first and second side 32, 34 of the housing 26 and through the side bricks 84 for heating first heating zone and to heat the upper chamber 21. In the preferred embodiment, the burners 66, 68, 72, 74 are spaced such that the spacing of the large side burners 68 on the first side 32 are staggered with spacing of the large side burners 68 on the second side 34 of the housing 26. Temperatures in the first section 42 within the first heating zone and inside the upper chamber 21 generally reach 1600 degrees F. or higher, which causes the wax to flow from the molds. The temperature sensors in the first section 42 can be used to detect when the wax begins to burn and burners 66, 68, 72, 74 in the first section 42 can then be adjusted as needed.

In the second section 44, a first partition 86 (FIG. 9) is attached to and extends downwardly from the upper fiber panels 58. The first partition 86 extends between the side fiber panels 60 is disposed adjacent to the first section 42. A second partition 88 is attached to and extends downwardly from the upper fiber panels 58 toward the bottom 30 of the housing 26. The second partition 88 extends between the side fiber panels 60 and is disposed in a spaced relationship with the first partition 86. A second heating zone is defined by and extends between the first partition 86 and the second partition 88 and the tiles 64 and the upper fiber panels 58 and the side fiber panels 60. A third partition 90 is attached to and extends downwardly from the upper fiber panels 58 toward the bottom 30 of the housing 26. The third partition 90 extends between the side fiber panels 60 and is disposed in an spaced relationship with the second partition 88. A third heating zone is defined by and extends between the second partition 88 and the third partition 90 and the tiles 64 and the upper fiber panels 58 and the side fiber panels 60. A plurality of large side burners 68 are spaced at predetermined intervals along the second section 44. The large side burners 68 extend through the first side 32 and second side 34 of the housing 26 and through the side fiber panels 60 for heating the second heating zone and the third heating zone. A plurality of small side burners 72 are spaced at predetermined intervals along the second section 44 and extend through the first and second side 32, 34 of the housing 26 and through the foundation bricks 56 for heating exhaust vapors in the lower chambers 24.

Figure 10:
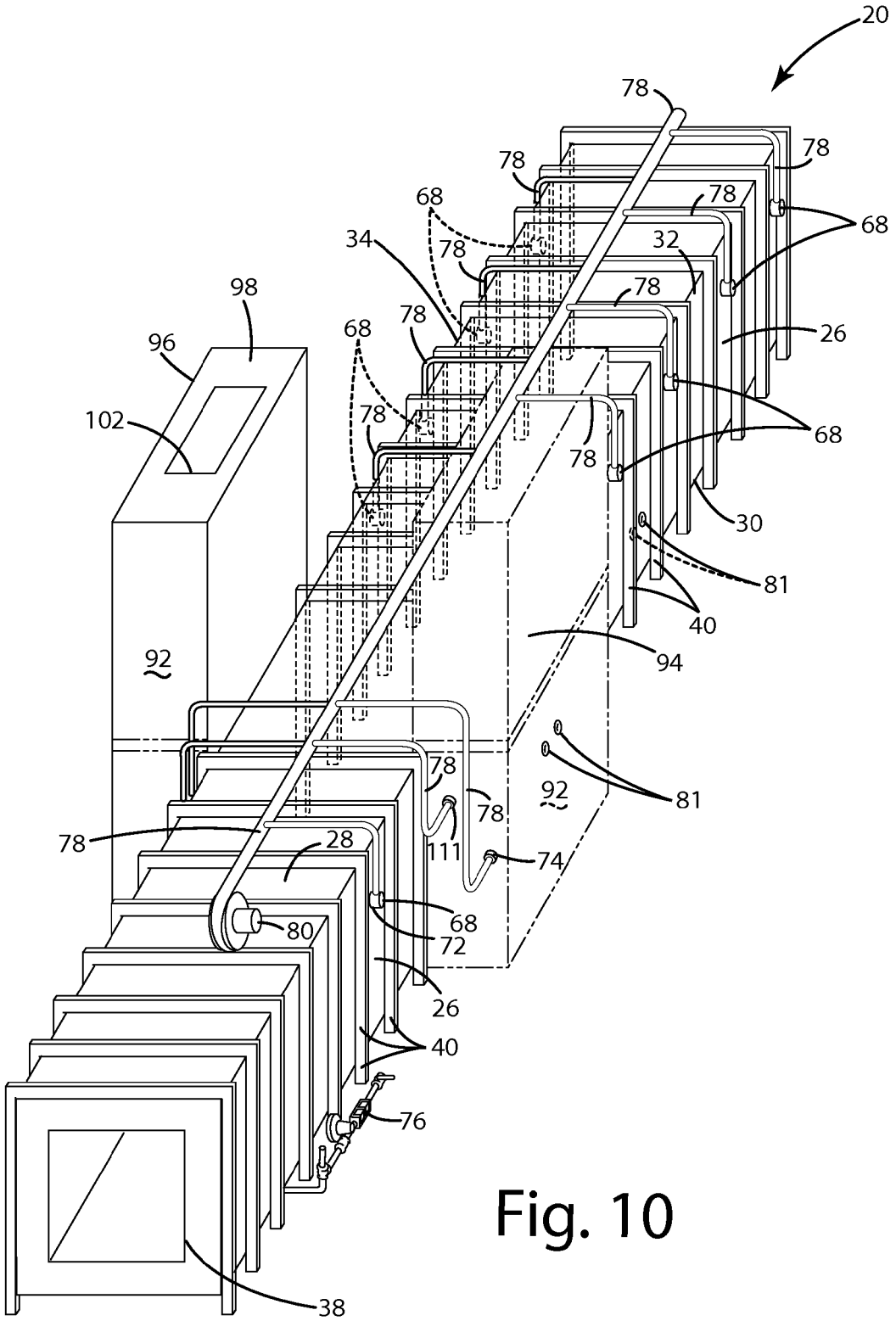
FIG. 10 is an isometric view of the furnace assembly.

In the third section 46, the housing 26 further defines a flue case 92 (FIG. 10) of steel having a generally C-shaped cross-section and extending outwardly from the first side 32 and from the second side 34 of the housing 26. The flue case 92 defines a first chimney 94 extending along the first side 32 from the bottom 30 and extending beyond the top 28 of the housing 26. Similarly, the flue case 92 defines a second chimney 96 extending along the second side 34 of the housing 26 from the bottom 30 and extending beyond the top 28 of the housing 26. A plurality of flue bricks 98 are disposed in the first chimney 94 and extending from the bottom 30 of the housing 26 and along the first side 32 of the housing 26. Likewise, a plurality of flue bricks 98 are also disposed in the second chimney 96 and extending from the bottom 30 of the housing 26 and along the second side 34 of the housing 26. The first chimney 94 and second chimney 96 are for containing gases exhausted through the lower chambers 24. Each chimney defines a lower flue opening 100 connected to the lower chambers 24 and an upper flue opening 102 at the opposite end of the chimneys 94, 96 for exhausting combustion gases out of the furnace assembly 20 to an outside environment. Additional sensor ports 81 are defined by the flue case 92 (FIG. 10). At least two sensors are disposed in the sensor ports and extend into the chimneys 94, 96, one high limit and one control temperature to provide feedback as needed. Because the vast majority of the wax is completely burned in the furnace assembly 20 of the present invention, the exhaust through the chimneys 94, 96 is substantially cleaner than with other dewaxing furnaces.

The third section 46 also includes a barrier 104 extending between the flue opening of the first chimney 94 and the flue opening of the second chimney 96 to prevent exhaust gases flowing through the lower chambers 24 from entering the third section 46 or the fourth section 48 of the furnace assembly 20. A first outlet 106 having a generally rectangular shape defined by the tiles 64 and barrier 104 extends through the tiles 64 for evacuating the air from the third section 46 to the first chimney 94 and the second chimney 96. A first fresh air inlet 108 extending through the upper fiber panels 58 into the third section 46 provides fresh air to the third section 46.

Figure 4:
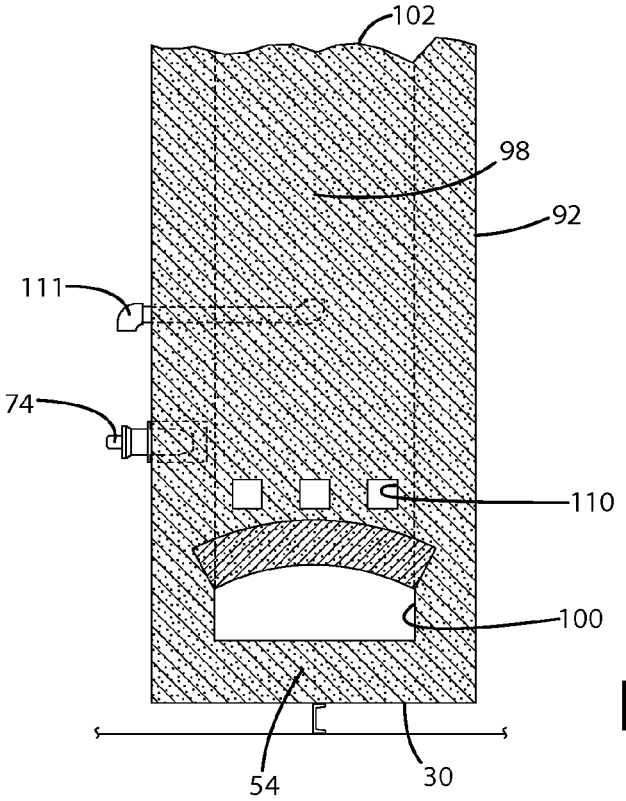
FIG. 4 is a cross-sectional view of the furnace assembly taken along IV-IV of FIG. 1.

The flue bricks 98 in the third section 46 also define a plurality of flue voids 110 each extending into the first chimney 94 and into the second chimney 96 for exhausting air to the chimneys 94, 96. A pair of flue burners 74 (FIGS. 1, 4 and 10) extend through the flue case 92 into the first chimney 94 and into the second chimney 96 for heating exhaust vapors flowing through the lower chambers 24 into the first chimney 94 and into the second chimney 96. In the preferred embodiment, the flue burners 74 are inclined slightly toward the upper flue opening 102 of each of the chimneys 94, 96 to assist in the upward flow of exhaust vapors through the chimneys 94, 96. By heating in this fashion, a venturi effect is created which more efficiently moves exhaust vapors through the first chimney 94 and the second chimney 96 to the outside environment. In other words, the flue burners 74 in addition to assisting in the combustion of any remaining wax vapor, help pull the air through the lower chamber 24, thereby sucking all the wax and vapors downward in the first section 42 into the lower chamber 24. However, at least one afterburner may optionally be utilized in the chimneys 94, 96 to help maintain the proper temperature, as well as keeping the chimneys 94, 96 clean. At least one second fresh air inlet 111 (FIGS. 4 and 10) extends through the flue case 92 into the first chimney 94 and into the second chimney 96 for introducing fresh air into the stream of exhaust vapors flowing into the first chimney 94 and into the second chimney 96. This fresh air helps cool and assist exhaust vapors to exit the first chimney 94 and to exit the second chimney 96.

In the fourth section 48, a second outlet 112 having a generally rectangular shape is defined by the tiles 64 and barrier 104 and extends through the tiles 64 for evacuating the air from the fourth section 48 to the first chimney 94 and the second chimney 96. Because cooling of the investment casting molds occurs in the fourth section 48, it is important that air is exhausted as needed through the chimneys 94, 96. The flow through the second outlet 112 is also assisted by the flow of exhaust through the lower chambers 24 into the chimneys 94, 96, which helps provide a venturi effect. A fourth partition 114 is attached to and extends downwardly from the upper fiber panels 58 toward the bottom 30 of the housing 26. The fourth partition 114 extends between the side fiber panels 60 and is disposed in an spaced relationship with the third partition 90. A first cooling zone is defined by and extends between the third partition 90 and the fourth partition 114 and the tiles 64 and the upper fiber panels 58 and the side fiber panels 60. At least one small side burner 72 extends through the first side 32 and second side 34 of the housing 26 in the second section 44 and through the side fiber panels 60 for heating the first cooling zone. Although it may seem counterintuitive to provide heat to a cooling zone, gradual cooling is important so as not to damage the molds and may also be required depending on the ambient temperature in which the furnace assembly 20 is operated (e.g. in winter time, with lower ambient temperatures, it may be necessary to operate the small side burner 72 to ensure an optimal cooling zone temperature).

The fourth section 48 further defines a second cooling zone and a third cooling zone. At least one small side burner 72 extends through the first side 32 and second side 34 of the housing 26 in the fourth section 48 and through the side fiber panels 60 for heating the second cooling zone as needed. A third fresh air inlet 116 extends through the upper fiber panels 58 into the fourth section 48 for providing fresh air to the fourth section 48.

The fourth section 48 also includes a plurality of raised bricks 118 disposed on the bottom 30 of the housing 26 and extending from the third section 46 along the fourth length to the exit of the housing 26. As best shown in FIGS. 2 and 10, the bottom 30 of the housing 26 is elevated in the fourth section 48 for supporting the raised bricks 118.

As best shown in FIG. 2, the raised bricks 118 and the tiles 64 in the first section 42 and second section 44 and third section 46 define a planar platform 120 extending generally parallel to the top 28 and the bottom 30 of the housing 26 through the first section 42 and the second section 44 and the third section 46 and the fourth section 48. The planar platform 120 and side bricks 84 and side fiber panels 60 and upper bricks 82 and upper fiber panels 58 define the upper chamber 21. A conveyor 122 is attached to and is supported by the conveyor 122 platform extending through the first section 42 and the second section 44 and the third section 46 and the fourth section 48 for conveying the investment casting molds through the furnace assembly 20.

Figure 8:
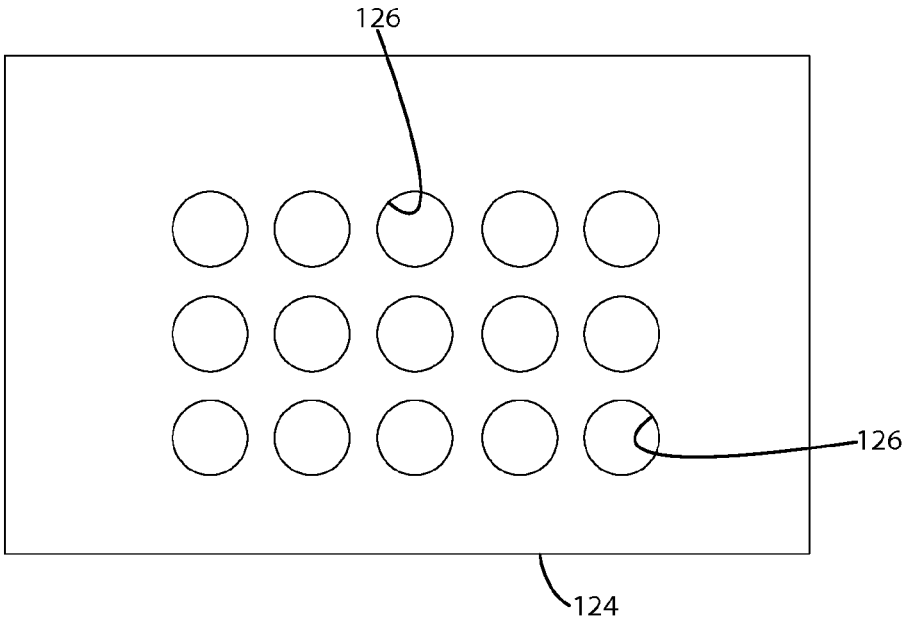
FIG. 8 is a top plan view of the tray.

A plurality of trays 124 (FIG. 8) are used for carrying investment casting molds along the conveyor 122. The trays 124 each have at least one aperture 126 for allowing heat to rise to the investment casting molds on the tray 124 and for allowing molten wax from the molds to drop through the trays 124. By using apertures in the trays 124, the wax may be moved away from the molds and the tray 124 can also act as a diffuser and separates the wax burning from the molds.

In operation, the load of molds is moved into the furnace assembly 20 on the trays 124 and enters the first section 42 and is heated in the first heating zone to evacuate the wax from the molds and burn the wax. The temperature in the first heating zone increases. The negative pressure created by the passageway 22 and lower chambers 24 helps keep flames and wax vapors moving down into the lower chambers 24. The air is pulled into the lower chambers 24 due to the flue burners 74 causing a flow of exhaust out through the chimneys 94, 96 which sucks air into the passageway 22. The trays 124 progress through the second and third heating zones. The lower burners 66 are used to heat the lower chambers 24 and to ignite the wax vapors as they travel through the lower chambers 24, which increases the temperature through the first section 42 and the second section 44 of the furnace assembly 20. Because the wax is burning, air rather than fuel is primarily supplied by the lower burners 66 during this stage. As much as 20,000 cubic feet of air may be introduced through the lower burners 66 at this stage. The lower burners 66 proportionally ramp up or down depending on if the wax has already been burnt and depending on how much air must be introduced while the wax is burning. Although the lower burners 66 could shut off while the wax is burning, typically they operate at a very low setting until the temperature spike from the wax is over and then use progressively more fuel while decreasing air until the next load of trays 124 enters the furnace assembly 20.

The flue burners 74 maintain the proper temperature in the chimneys 94, 96 and the chimneys 94, 96 exhaust vapors moving through the lower chambers 24. The amount of the wax burned may vary for example between 160 lbs./hr. to 80 lbs./hr. As the wax is consumed by burning, the burners 66, 68, 72, 74 may be adjusted to maintain the proper temperature in the lower chambers 24. The upper burners 66, 68, 72, 74 may be allowed to shut down as heat radiates from the lower chambers 24. The trays 124 then move through the first cooling zone and second cooling zone and third cooling zone which progressively allow the molds on the trays 124 to cool properly. Fresh air is introduced through the first fresh air inlet 108 into the third section 46 and the third fresh air inlet 116 introduces fresh air into the fourth section 48 as needed in the cooling process. Finally, the trays 124 carrying the molds exit the furnace assembly 20.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A furnace comprising:

an outer housing defining an inner cavity and wherein said cavity is at least partially divided into an upper chamber and a lower chamber, and wherein said lower chamber includes a divider extending along the majority of the length of said lower chamber between said first end and said chimney, and wherein said divider divides said lower chamber into two longitudinally extending chambers;

a chimney having an opening substantially aligned with said lower chamber;

at least one burner extending into said lower chamber;

at least one burner extending into said upper chamber; and a passageway located proximate to said first end extends between said lower chamber and said upper chamber.

2. The furnace of claim 1 further including a second end with an opening opposite said first end, and where said chimney is located between said first and second ends.

3. The furnace of claim 2 wherein said outer housing includes a door at a first end.

4. The furnace of claim 3 wherein said at least one burner extending into said lower chamber includes a first lower burner aligned with one of said two longitudinally extending chambers and a second lower burner aligned with the other of said two longitudinally extending chambers, and wherein said first and second lower burners are located on said first end under said door.

5. The furnace of claim 4 wherein said first and second lower burners are each configured to force hot air from said first section through said second section and to the opening on said at least one chimney in said third section, and wherein said first and second lower burners in combination with said second section create a venturi effect in said first section by drawing air from said upper chamber through said passageway to said lower chamber.

6. The furnace of claim 1 wherein said at least one chimney includes a chimney burner.

7. The furnace of claim 6 wherein said at least one chimney includes a fresh air inlet.

8. The furnace of claim 1 wherein said at least one burner extending into said upper chamber further includes a plurality of burners extending into said upper chamber of said first section.

9. A furnace comprising:

an outer housing defining an inner cavity and wherein said cavity is at least partially divided into an upper chamber and a lower chamber, and a chimney having an opening substantially aligned with said lower chamber;

at least one burner extending into said lower chamber;

at least one burner extending into said upper chamber; and a passageway located proximate to said first end extends between said lower chamber and said upper chamber; and wherein said furnace includes a first section adjacent to said entrance and wherein said passageways are located within said first section, a second section adjacent to said first section and extending away from said first end, a third section adjacent to said second section and wherein said chimneys are located in said third section and a fourth section extending away from said third section.

10. The furnace of claim 9 wherein said lower chamber in said first and second sections are divided by a longitudinally extending divider and wherein said third section is substantially free from said longitudinally extending divider.

11. The furnace of claim 10 wherein said third section includes a laterally extending barrier aligned with said opening on said chimney and wherein said opening extends past both sides of said barrier.

12. The furnace of claim 9 wherein said lower chamber does not extend into said fourth section and wherein said fourth section terminates in an opening at said second end.

13. The furnace of claim 12 wherein said opening is not covered by a door.

14. The furnace of claim 9 wherein said at least one chimney includes a chimney burner.

15. The furnace of claim 9 wherein said at least one chimney includes a fresh air inlet.

16. A furnace comprising:

an outer housing defining an inner cavity and wherein said cavity is at least partially divided into an upper chamber and a lower chamber and a chimney having an opening substantially aligned with said lower chamber;

at least one burner extending into said lower chamber;

at least one burner extending into said upper chamber; and a passageway located proximate to said first end extends between said lower chamber and said upper chamber; and wherein said includes a first section adjacent to said entrance and wherein said passageways are located within said first section, a second section adjacent to said first section and extending away from said first end, a third section adjacent to said second section and wherein said chimneys are located in said third section and a fourth section extending away from said third section; and wherein said at least one burner extending into said upper chamber includes a plurality of upper chamber burners on a first side and a plurality of upper chamber burners on an opposing second side in said second section, and wherein said plurality of upper burners on said first side are staggered relative to said plurality of upper chamber burners on said second side.

17. A furnace comprising:

an outer housing defining an inner cavity and wherein said cavity is at least partially divided into an upper chamber and a lower chamber, and a chimney having an opening substantially aligned with said lower chamber;

at least one burner extending into said lower chamber;

at least one burner extending into said upper chamber; and a passageway located proximate to said first end extends between said lower chamber and said upper chamber; and a first section adjacent to said entrance and wherein said passageways are located within said first section, a second section adjacent to said first section and extending away from said first end, a third section adjacent to said second section and wherein said chimneys are located in said third section, and wherein said an inner side of said outer housing is lined with furnace bricks in said upper chamber and said lower chamber in said first section.

18. The furnace of claim 17 wherein said inner side of said outer housing in said second section is fiber lined in said upper chamber and furnace brick lined in said lower chamber in said second section.

19. The furnace of claim 18 wherein the floor of said upper chamber is furnace brick lined.

20. The furnace of claim 19 further including a material handling system to move products from said first end to said second end.

21. The furnace of claim 17 wherein said furnace brick lining in said first section includes an arched roof to said upper chamber.

22. The furnace of claim 17 further including a first partition extending downward and dividing said first section from said second section.

23. The furnace of claim 22 further including a plurality of partitions extending downward in said second section.

24. A furnace assembly comprising:

a housing having a longitudinal extent and a latitudinal extent and a top and a bottom and a first side and a second side and extending along the longitudinal extent to define a cavity;

at least one chimney connected to said housing;

at least one burner extending into said cavity;

a plurality of tiles supported in a spaced relationship with said bottom of said housing and defining at least one lower chamber extending along the longitudinal extent for containing combustion of vapors along the chamber and directing the vapors from said cavity to said chimneys; and a passageway defined by said tiles extending through said tiles for evacuating the vapors from said cavity to said lower chambers.

25. A dewaxing furnace assembly for investment casting comprising:

a housing having a longitudinal extent and a latitudinal extent and a top and a bottom and a first side and a second side and extending along an axis to define a cavity;

at least one chimney connected to said housing;

at least one burner extending into said cavity;

a plurality of tiles supported in a spaced relationship with said bottom of said housing and defining at least one lower chamber extending along the longitudinal extent for containing combustion of wax vapors along the chamber and directing the wax vapors from said cavity to said chimneys;

a passageway defined by said tiles extending through said tiles for evacuating the wax vapors from said cavity to said lower chambers; and at least one burner extending into said lower chambers for igniting wax vapors in said lower chambers.

26. A dewaxing furnace assembly for investment casting comprising:

a housing having a longitudinal extent and a latitudinal extent and a top and a bottom and a first side and a second side and extending along the longitudinal extent to define a cavity;

at least one chimney connected to said housing;

a plurality of tiles supported in a spaced relationship with said bottom of said housing and defining at least one lower chamber extending along the longitudinal extent for containing combustion of wax vapors along the chamber and directing the wax vapors from said cavity to said chimneys;

a passageway defined by said tiles extending through said tiles for evacuating the wax vapors from said cavity to said lower chambers;

at least one burner extending into said lower chambers for igniting wax vapors in said lower chambers;

a plurality of trays for carrying investment casting molds along said housing; and said trays each having at least one aperture for allowing heat to rise to molds on said trays and for allowing molten wax from the molds to drop through said trays into said lower chambers through said passageway.

* * * * *